US008147180B2

(12) United States Patent
Tani et al.

(10) Patent No.: US 8,147,180 B2
(45) Date of Patent: Apr. 3, 2012

(54) AXIAL FLOW TURBINE AND STAGE STRUCTURE THEREOF

(75) Inventors: Kentaro Tani, Kanagawa (JP); Sakae Kawasaki, Kanagawa (JP); Akihiro Onoda, Kanagawa (JP); Daisuke Nomura, Kanagawa (JP); Hiroshi Kawakami, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 804 days.

(21) Appl. No.: 12/243,642

(22) Filed: Oct. 1, 2008

(65) Prior Publication Data

US 2009/0110550 A1 Apr. 30, 2009

(30) Foreign Application Priority Data

Oct. 3, 2007 (JP) ..... 2007-259480

(51) Int. Cl.
*F01D 11/00* (2006.01)

(52) U.S. Cl. ..... 415/110; 415/115; 415/117; 415/173.1; 415/173.5; 415/173.6; 415/914

(58) Field of Classification Search ..... 415/117, 415/173.5, 173.6
See application file for complete search history.

(56) References Cited

U.S. PATENT DOCUMENTS 3,597,102 A * 8/1971 Unsworth et al. ..... 415/112
2005/0025617 A1* 2/2005 Suzuki et al. ..... 415/173.5

FOREIGN PATENT DOCUMENTS

JP 60-114202 U 8/1985
JP 3-107504 A * 5/1991
JP 10-266808 A 10/1998
JP 2003-138906 A 5/2003
JP 2006-097544 A 4/2006

* cited by examiner

*Primary Examiner* — Stephen W Smoot
(74) *Attorney, Agent, or Firm* — Foley & Lardner LLP

(57) ABSTRACT

An axial flow turbine stage structure has: an annular diaphragm inner ring; an annular diaphragm outer ring arranged radially outside and coaxially with the diaphragm inner ring and separated from the diaphragm inner ring by an annular flow path interposed between them; stationary blades arranged peripherally at intervals in the annular flow path and rigidly secured to the diaphragm inner ring and the diaphragm outer ring; and moving blades rigidly secured to the outer periphery of a rotatable rotor and arranged peripherally at intervals respectively at axially downstream sides of the stationary blades. Through holes are formed in the diaphragm outer ring so as to allow axial upstream side and axially downstream side of the stationary blades to communicate with each other.

7 Claims, 3 Drawing Sheets

AXIAL FLOW TURBINE AND STAGE STRUCTURE THEREOF

CROSS REFERENCES TO RELATED APPLICATIONS

This application is based upon and claims the benefit of priority from the prior Japanese Patent Application No. 2007-259480, filed in the Japanese Patent Office on Oct. 3, 2007, the entire content of which is incorporated herein by reference.

BACKGROUND OF THE INVENTION

The present invention relates to a stage structure of an axial flow turbine where fluid flows in the axial direction. More particularly, the present invention relates to a stage structure of an axial flow turbine that can reduce the stage loss arising from turbine stages.

A typical conventional stage structure of an axial flow turbine will be described below for its configuration by referring to FIG. 5.

FIG. 5 is a schematic illustration of a structure of stages of an axial flow turbine where fluid flows in the axial direction. A plurality of stationary blades 3 are arranged in a row at predetermined regular intervals in a peripheral direction between a diaphragm outer ring 1 and a diaphragm inner ring 2. A plurality of moving blades 6 are arranged facing the turbine stationary blades at the downstream side of the turbine stationary blades. The turbine moving blades 6 are arranged respectively at the outer peripheries of rotor disks 4 in a row at predetermined regular intervals in a peripheral direction.

The turbine stationary blades 3 arranged in the above-described manner lead the main stream 7 of turbine working fluid between the blades and allow it to pass through them so as to make the stationary blade inlet pressure P1 decrease the outlet pressure P2 and accelerate the move of working fluid. The fluid, which has passed turbine stationary blades 3 and has been accelerated by the latter, then flows to the moving blades 6, and the kinetic energy of the fluid is converted into rotational mechanical energy.

On the other hand, the stationary blades 3 and the moving blades 6 resist the flow of fluid so that the flowing site of fluid that passes the stationary blades 3 and the moving blades 6 gives rise to a turbulence loss. Major losses that arise in the row of blades include a blade element loss (hereinafter referred to as "profile loss") and a secondary loss which takes place on the wall surfaces of the root sections and the tip sections of the blades of the row. Besides the profile loss and the secondary loss listed above, losses arise from between adjacent stages includes: a shaft leak loss produced by fluid flowing through the gap (or the labyrinth) between each stationary blade diaphragm inner ring 2 and the rotor shaft; a blade tip leak loss produced by fluid flowing through the gap (or the labyrinth) between the tip of each moving blade 6 and the corresponding stationary blade diaphragm outer ring 1; and a moisture loss.

FIG. 6 shows a typical breakdown of the loss that arises between stages. The leak losses that take place at the shaft and at the blade tip 3 are unignorably large if compared with the profile loss and the secondary loss that are recognized as major losses in the row of blades of the stages. Particularly, since the blade tip leaking fluid 10 does not pass the row of blades and hence does not work in the stages, the quantity of the leaking fluid directly affects the loss of the entire stages. The magnitude of the leak loss in each stage is determined as a function of: the distance of the gap between the stationary blade diaphragm inner ring and the shaft or the distance of the gap (labyrinth) between the shroud 5 of the moving blade tip and the corresponding stationary blade diaphragm outer ring 1, and the pressure difference between the stationary blade and the moving blade. Therefore, the leak loss can be theoretically reduced by reducing the gap between the stationary blade diaphragm inner ring 2 and the shaft or the distance of the gap (labyrinth) between the shroud 5 of the moving blade tip and the corresponding stationary blade diaphragm outer ring 1. However, the gaps cannot be reduced less than a certain lower limit, because the influence of the elongation of the rotor and that of the diaphragms by heat needs to be taken into consideration for actual operations.

Now, the general flow of fluid between stages in an axial flow turbine will be described below by referring to FIG. 5. When the main flow 7 of fluid enters the nozzle, part of the fluid of the main flow 7 passes through the gap between the stationary blade diaphragm inner ring 2 and the shaft as shaft leaking fluid 8 and then joins the main flow at the moving blade inlet.

Similarly, when the main flow 7 of fluid passes the moving blade 6, part of the fluid of the main flow 7 passes through the gap between the moving blade tip shroud 5 and the stationary blade diaphragm outer ring 1 as blade tip leaking fluid 10 and then joins the main flow at the stationary blade inlet of the next stage. A local turbulence occurs in the main flow on and near the wall surface where such leaking fluid departs from and joins the main flow. Then, the angle of flow is shifted on and near the wall surface due to the local turbulence of the main flow to increase the difference between the geometrical angle of the blade front edge and the angle of the main flow to increase the loss (incidence loss) in the row of blades. Additionally, the turbulence of the main flow promotes the development of the secondary flow vortexes, which arise at the roots of the moving blades and at the tips of the stationary blades, at the moving blade inlet and the stationary blade inlet where leaking fluid joins the main flow. In this way, the stage loss is increased as leaking fluid interferes with the main flow and the influence of the stage loss becomes more significant as the quantity of leaking fluid increases.

In view of the above-identified problems, various methods have been proposed to date for the purpose of reducing the quantity of leaking fluid and the interference of leaking fluid relative to the main flow.

Currently, a technique of arranging a plurality of fins 11 in the gap between the stationary blade diaphragm inner ring 2 and the shaft or in the gap between the moving blade tip and the stationary blade diaphragm outer ring 1 in order to reduce leaking fluid as shown in FIG. 5 is known as a technique for reducing the leak losses at the shaft and at the blade tips. Japanese Patent Application Laid-Open Publication No. 2006-097544 discloses a technique of arranging a labyrinth seal that is formed by a plurality of fins in the gap between the stationary blade diaphragm inner ring and the shaft and also in the gap between the moving blade tips and the stationary blade diaphragm outer ring.

An improved efficiency of turbines can save energy and hence is believed to contribute to the policy of reducing the environment load. Efforts are currently being paid to develop high efficiency turbines.

Particularly, the efficiency of turbines is improved by improving the performance of turbine stages. In other words, the efficiency of turbines is improved effectively by reducing the losses that arise in turbine stages and thereby improving the performance of turbines. Particularly, the performance of turbine stages can be improved remarkably by reducing leak losses and blade row losses that arise when leaking fluid interferes with the main flow. As pointed out above, techniques for reducing the leak loss at the shaft and the blade tips have been proposed. Such proposed techniques include those for reducing leaking fluid by arranging several fins in the gap between the stationary blade diaphragm inner ring and the shaft or the gap between the moving blade tips and the stationary blade diaphragm outer ring.

However, no technique for suppressing the interference of leaking fluid with the main flow after passing the gap between the moving blade tips and the stationary blade diaphragm outer ring has been established to date.

BRIEF SUMMARY OF THE INVENTION

The present invention solves the above problem. The object of the present invention is to provide a highly efficient axial flow turbine and a stage structure thereof that can reduce the stage losses by actively controlling the leaking fluid passing through the gap between the moving blade tips and the stationary blade diaphragm outer ring and suppressing the interference thereof with the main flow.

In order to attain the object, according to an aspect of the present invention, there is provided an axial flow turbine stage structure comprising: an annular diaphragm inner ring; an annular diaphragm outer ring arranged radially outside and coaxially with the diaphragm inner ring and separated from the diaphragm inner ring by an annular flow path interposed therebetween; a plurality of stationary blades arranged peripherally at intervals in the annular flow path and rigidly secured to the diaphragm inner ring and the diaphragm outer ring; and a plurality of moving blades rigidly secured to the outer periphery of a rotatable rotor and arranged peripherally at intervals respectively at axially downstream sides of the stationary blades; wherein a plurality of through holes are formed in the diaphragm outer ring so as to allow axial upstream side and axially downstream side of the stationary blades to communicate with each other.

According to another aspect of the present invention, there is provided an axial flow turbine comprising: an annular diaphragm inner ring; an annular diaphragm outer ring arranged radially outside and coaxially with the diaphragm inner ring and separated from the diaphragm inner ring by an annular flow path interposed therebetween; a plurality of stationary blades arranged peripherally at intervals in the annular flow path and rigidly secured to the diaphragm inner ring and the diaphragm outer ring; and a plurality of moving blades rigidly secured to outer periphery of a rotatable rotor and arranged peripherally at intervals respectively at axially downstream sides of the stationary blades; wherein a plurality of through holes are formed in the diaphragm outer ring so as to allow axial upstream side and axially downstream side of the stationary blades to communicate with each other.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Now, the present invention will be described in greater detail by referring to FIGS. 1 through 4 that illustrate preferred embodiments of the invention. In FIGS. 1 through 4, the components same as or similar to those of the prior art are denoted respectively by the same reference symbols and will not be described repeatedly.

First Embodiment

Figure 1:
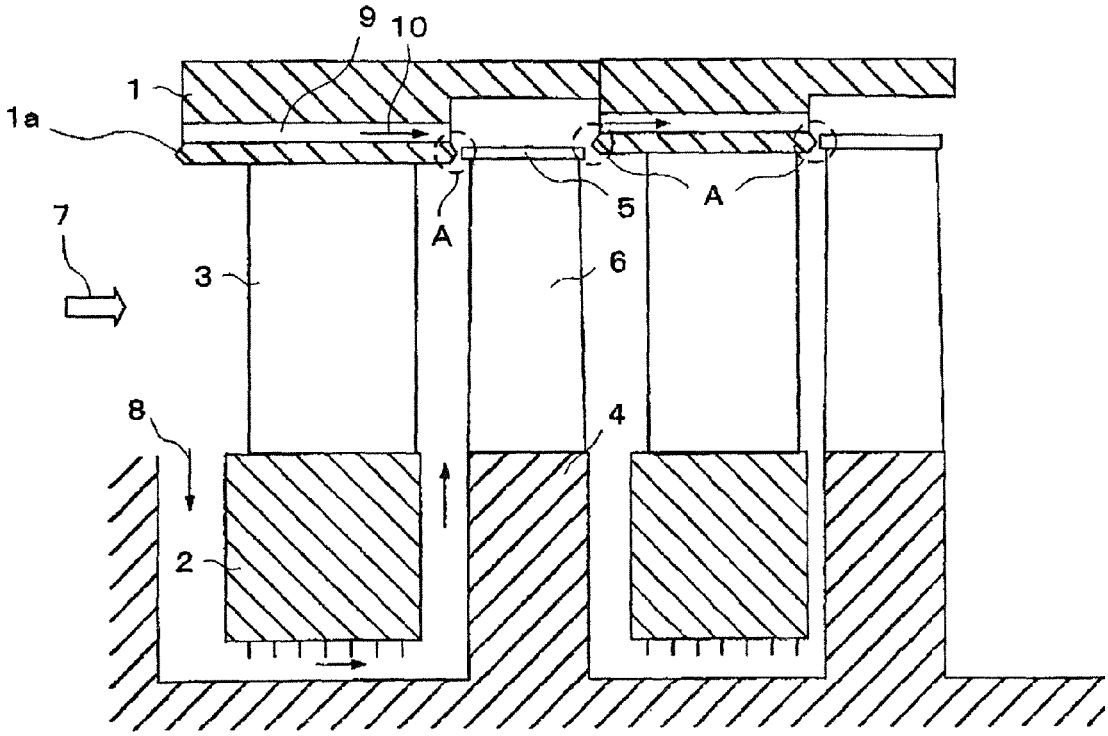
FIG. 1 is a schematic illustration of axial flow turbine stage structure according to a first embodiment of the present invention.

FIG. 1 schematically illustrates two mutually adjacent stages of an axial flow turbine according to the present invention. One stationary blade 3 and one moving blade 6 of each stage is illustrated. A plurality of stationary blades 3 are arranged peripherally at predetermined regular intervals in a row between a diaphragm outer ring 1 and a diaphragm inner ring 2. The same number of moving blades 6 are arranged at the downstream sides of the stationary blades 3 that are arranged in the above-described manner. The moving blades 6 are implanted in the outer peripheries of the rotor discs 4 and arranged at predetermined regular peripheral intervals in rows.

The stationary blade diaphragm outer ring 1 is provide with a plurality of axial through holes 9 arranged peripherally near the inner periphery thereof. The blade tip leaking fluid 10 that has passed through the gap between the moving blade tips and the stationary blade diaphragm outer ring 1 can pass through the through holes 9. The stationary blade diaphragm outer ring 1 is provided at the inlet side end and at the outlet side end thereof with ridges 1*a* that are located near the inner periphery of the outer ring 1, or at positions close to the corresponding stationary blades 3, to limit the blade tip leaking fluid 10 branching into the gap between the stationary blade diaphragm outer ring 1 and the tip shroud 5 of the moving blades 6 from the main flow 7 and also the leaking fluid returning to the main flow 7 after branching from the main flow. The ridges 1*a* may have a cross section with an acute vertex, a profile of a thin plate or some other form. The ridges 1*a* may be integrally molded with the stationary blade diaphragm outer ring 1 or produced separately relative to the stationary blade diaphragm outer ring 1 and bonded to the outer ring 1 by welding.

As shown in FIG. 1, a stage is formed by means of a combination of a row of peripherally arranged stationary blades 3 and a row of peripherally arranged moving blades 6, and a plurality of stages are arranged axially.

Figure 2:
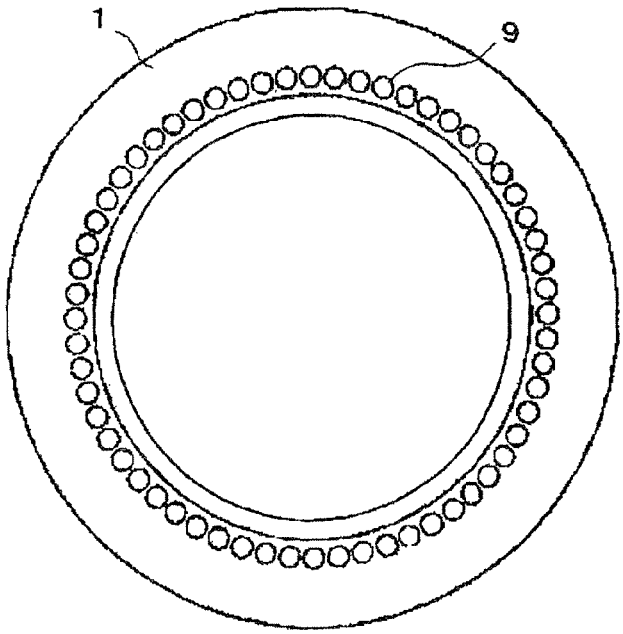
FIG. 2 is a schematic front view of the stationary blade diaphragm outer ring according to the first embodiment of the present invention where through holes are provided.

FIG. 2 is a schematic front view of the stationary diaphragm outer ring 1 of the first embodiment. A plurality of through holes 9 are arranged peripherally to run through the stationary blade diaphragm outer ring 1 from the stationary blade inlet side to the stationary blade outlet side. The profile, or the cross sectional shape (circular, elliptic, polygonal, for example), the number and the way of arrangement of the through holes 9 may be selected appropriately according to the mechanical strength of the stationary blade diaphragm outer ring 1, the rate at which leaking fluid flows and so on.

No labyrinth seal formed by using fins are provided in the gap between the moving blade tip shroud 5 and the stationary blade diaphragm outer ring 1 in the first embodiment. However, such a labyrinth seal may be provided depending on the required stage loss characteristics of the stage.

A labyrinth seal as described in Japanese Patent Application Laid-Open No. 2006-97544 may be arranged in the axial gap between the inner periphery of the stationary blade diaphragm outer ring 1 and the moving blade tips 5 instead of the provision of the ridges 1*a*. In short, what is essential is to provide a resistor relative to fluid.

With this first embodiment, since blade tip leaking fluid 10 mostly flows through the through holes 9 and the gap between the tips of the moving blades 6 and the stationary blade diaphragm outer ring 1, both the rate at which fluid branches from the flow 7 and the rate at which fluid joins the main flow 7 are reduced and the turbulence of the main flow 7 is also reduced. Then, as a result, the angular change of the flow of fluid that arises locally near the wall surface of the stationary blades and that of the moving blades is reduced to reduce the incidence (angular) loss. Additionally, the secondary loss that is produced near the wall surface of the stationary blades and that of the moving blades by turbulence of the main flow 7 can be minimized. Then, a turbine stage showing a minimized stage loss can be realized to improve the stage efficiency.

Second Embodiment

Now, the second embodiment of the invention will be described below by referring to FIG. 3. The components same as or similar to those of the first embodiment are denoted respectively by the same reference symbols and will not be described here repeatedly.

Figure 3:
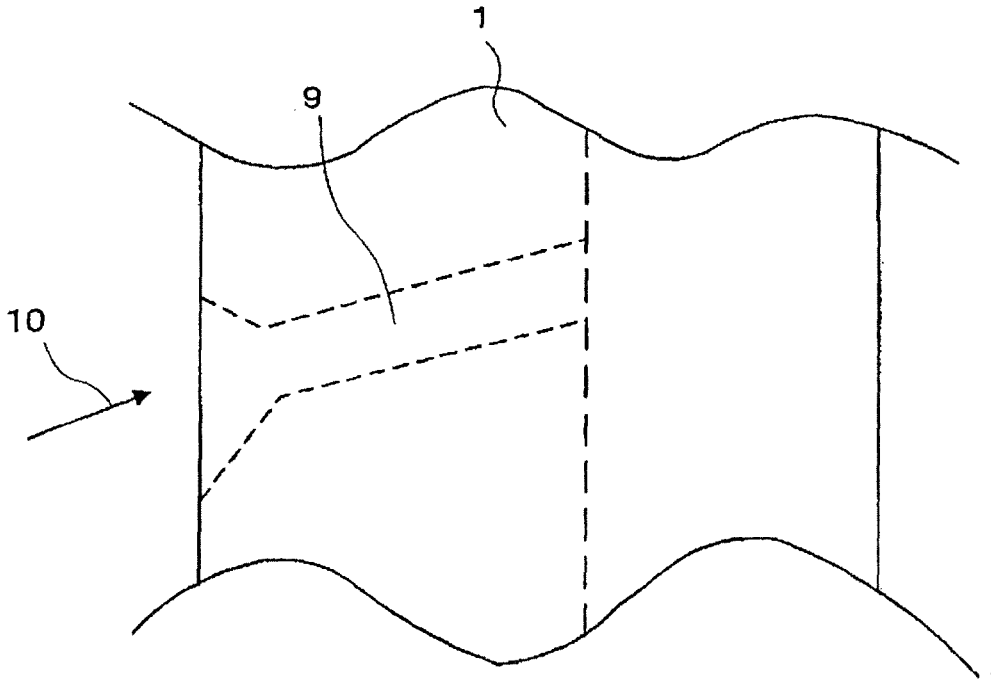
FIG. 3 is an enlarged sectional top view of a stationary blade diaphragm outer ring according to a second embodiment of the present invention where through holes are provided.

FIG. 3 is an enlarged schematic cross sectional view of one of the through holes 9 arranged in the stationary blade diaphragm outer ring 1. Since blade tip leaking fluid 10 have a peripheral velocity component, the through hole 9 is formed peripherally with an angle that agrees with the angle of the flow of the leaking fluid 10. With this arrangement, the leaking fluid 10 can smoothly pass through the through holes 9 and suppress any turbulence that may arise.

The diameter of the through holes 9 may be varied in the axial direction of the turbine. For example, the diameter of the through holes 9 may be increased at the inlet side where the blade tip leaking fluid 10 enters the through holes in order to minimize the turbulence that arises when the leaking fluid enters the through holes 9 and allow the leaking fluid to flow into the through holes 9 smoothly.

With the second embodiment, the turbulence of the tip blade leaking fluid 10 that flows into the through holes 9 can be minimized to by turn further improve the efficiency of passage of the tip blade leaking fluid 10 through the through holes 9. Then, as a result, both the rate at which fluid branches from the main flow 7 and the rate at which fluid joins the main flow 7 are reduced and the turbulence of the main flow 7 is also reduced. Thus, the angular change of the flow of fluid that arises locally near the wall surface of the stationary blades and that of the moving blades is reduced to reduce the incidence loss.

Third Embodiment

Figure 4:
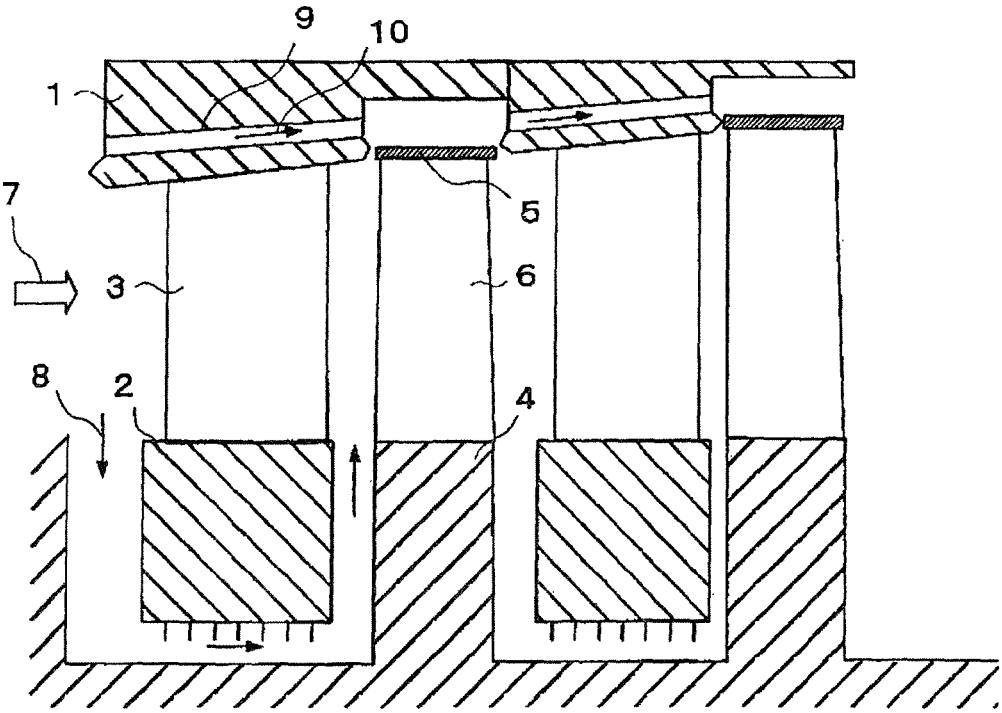
FIG. 4 is a schematic illustration of axial flow turbine stage structure according to a third embodiment of the present invention.
Figure 5:
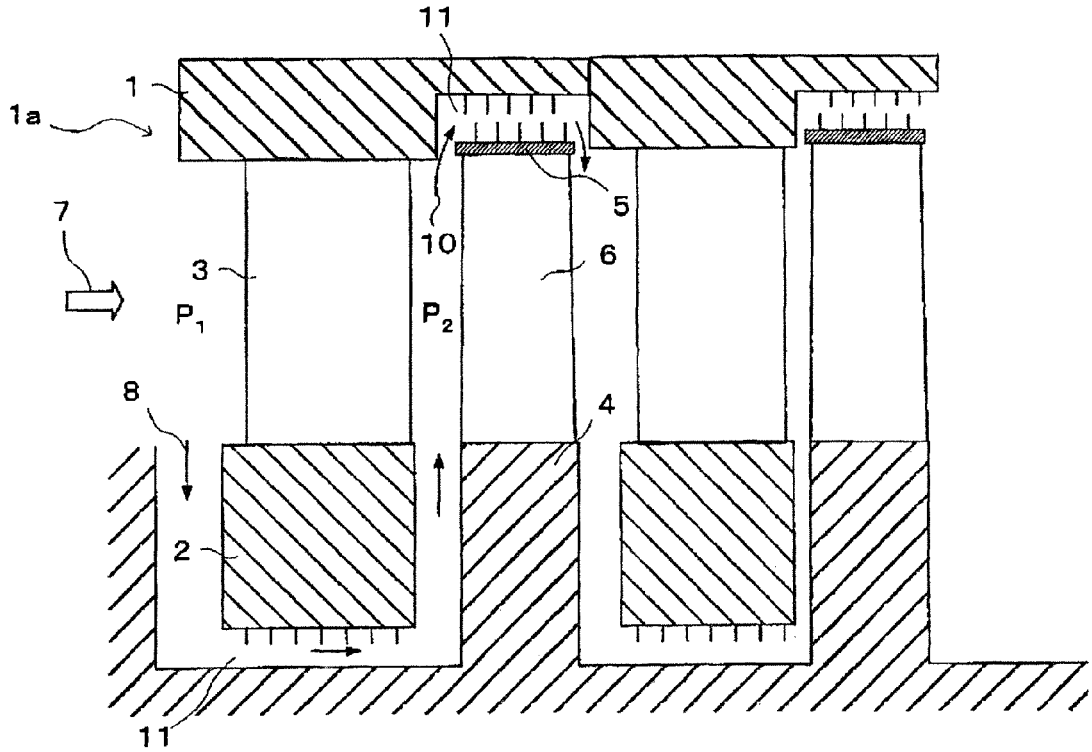
FIG. 5 PRIOR ART
FIG. 5 is a schematic illustration of a conventional axial flow turbine stage structure.
Figure 6:
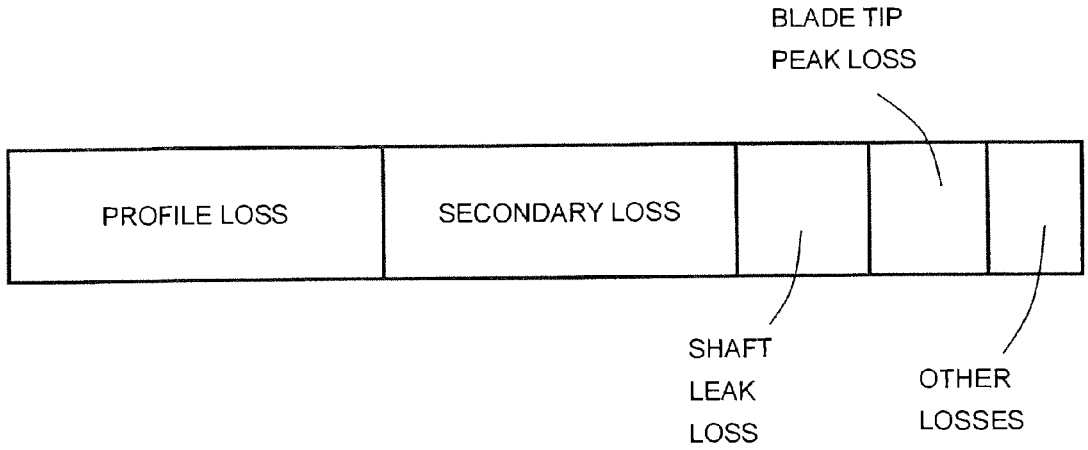
FIG. 6 PRIOR ART
FIG. 6 is an illustration of a typical breakdown of the loss that arises between stages of a conventional axial flow turbine.

Now, the third embodiment of the invention will be described below by referring to FIG. 4. The components same as or similar to those of the first embodiment are denoted respectively by the same reference symbols and will not be described here repeatedly.

The third embodiment is realized by applying the present invention to a turbine where the wall surface of the stationary blade front end is axially inclined. As shown in FIG. 4, the through holes 9 formed in the stationary blade diaphragm outer ring 1 are inclined radially outward or in the direction of the gap between the downstream side front end of the moving blades 6 and the stationary blade diaphragm outer ring 1.

With the third embodiment, the turbulence of the blade tip leaking fluid 10 flowing into the through holes 9 can be minimized so that it can flow through the through holes 9 further efficiently. Then, as a result, both the rate at which fluid branches from the main flow 7 and the rate at which fluid joins the main flow 7 are reduced and the turbulence of the main flow 7 is also reduced. Thus, the angular change of the flow of fluid that arises locally near the wall surface of the stationary blades and that of the moving blades is reduced to reduce the incidence loss.

Other Embodiments

The above-described embodiments are only exemplars for realizing the present invention, and the present invention is by no means limited thereto. Any of the characteristic features of each of the embodiments may be combined in various different ways.

What is claimed is:

1. An axial flow turbine stage structure comprising:

an annular diaphragm inner ring;

an annular diaphragm outer ring arranged radially outside and coaxially with the diaphragm inner ring and separated from the diaphragm inner ring by an annular flow path interposed therebetween;

a plurality of stationary blades arranged peripherally at intervals in the annular flow path and rigidly secured to the diaphragm inner ring and the diaphragm outer ring; and a plurality of moving blades rigidly secured to the outer periphery of a rotatable rotor and arranged peripherally at intervals respectively at axially downstream sides of the stationary blades; wherein a plurality of through holes are formed in the diaphragm outer ring so as to allow axial upstream side and axially downstream side of the stationary blades to communicate with each other, the cross sectional area of each of the through holes being varied in the axial direction of the turbine so as to be increased at an inlet thereof in order to allow fluid to flow through the through holes smoothly.

2. The structure according to claim 1, wherein the through holes are peripherally inclined in the turbine.

3. The structure according to claim 1, wherein the through holes are radially inclined in the turbine.

4. The structure according to claim 1, wherein an axially projecting ridge is formed on the stationary blade diaphragm outer ring at main flow inlet side or main flow outlet side of the outer ring at a position radially inner than the through holes so as to suppress flow of fluid passing through gap between tips of the moving blades and the stationary blade diaphragm outer ring.

5. The structure according to claim 1, wherein a labyrinth seal is formed in a gap between inner periphery of the stationary blade diaphragm inner ring and outer periphery of the rotor that are disposed radially facing each other.

6. The structure according to claim 1, wherein a labyrinth seal is formed in a gap between inner periphery of the stationary blade diaphragm outer ring and tips of the moving blades that are disposed radially facing each other.

7. An axial flow turbine comprising:

an annular diaphragm inner ring;

an annular diaphragm outer ring arranged radially outside and coaxially with the diaphragm inner ring and separated from the diaphragm inner ring by an annular flow path interposed therebetween;

a plurality of stationary blades arranged peripherally at intervals in the annular flow path and rigidly secured to the diaphragm inner ring and the diaphragm outer ring; and a plurality of moving blades rigidly secured to outer periphery of a rotatable rotor and arranged peripherally at intervals respectively at axially downstream sides of the stationary blades; wherein a plurality of through holes are formed in the diaphragm outer ring so as to allow axial upstream side and axially downstream side of the stationary blades to communicate with each other, the cross sectional area of each of the through holes being varied in the axial direction of the turbine so as to be increased at an inlet thereof in order to allow fluid to flow through the through holes smoothly.

* * * * *